US005244591A

United States Patent [19]

Middleton

[11] Patent Number: 5,244,591

[45] Date of Patent: Sep. 14, 1993

[54] LUBRICATING OIL COMPOSITIONS FOR INTERNAL COMBUSTION ENGINES HAVING SILVER BEARING PARTS

[75] Inventor: Wesley A. Middleton, Concord, Calif.

[73] Assignee: Chevron Research and Technology Company, San Francisco, Calif.

[21] Appl. No.: 855,955

[22] Filed: Mar. 23, 1992

[51] Int. Cl.[5] ..... C10M 135/02; C10M 129/40

[52] U.S. Cl. ..... 252/48.6; 252/56 R; 252/395; 252/396

[58] Field of Search ..... 252/56 R, 45, 48.6, 252/395, 396

[56] References Cited

U.S. PATENT DOCUMENTS

| | | | |
|---|---|---|---|
| 2,788,326 | 4/1957 | Bondi et al. | 252/56 |
| 2,788,826 | 4/1957 | Noonan . | |
| 2,830,956 | 4/1958 | Wasson et al. | 252/76 |
| 2,851,422 | 9/1958 | Manteuffel et al. | 252/75 |
| 3,041,284 | 6/1962 | Calhoun et al. | 252/48.6 |
| 3,112,269 | 11/1963 | Calhoun et al. . | |
| 3,112,271 | 11/1963 | Calhoun | 252/46.6 |
| 3,267,033 | 8/1966 | Allen | 252/32.7 |
| 4,131,551 | 12/1978 | Thompson et al. | 252/33 |
| 4,169,799 | 10/1979 | Sung et al. | 252/42.7 |
| 4,171,269 | 10/1979 | Sung et al. | 252/33 |
| 4,171,270 | 10/1979 | Sung et al. | 252/42.7 |
| 4,278,553 | 7/1981 | Sung et al. | 252/50 |
| 4,285,823 | 8/1981 | Sung et al. | 252/50 |
| 4,304,678 | 12/1981 | Schick et al. | 252/56 R |
| 4,376,056 | 3/1983 | Erdman | 252/56 R |
| 4,412,928 | 11/1983 | Holstedt et al. | 252/46.4 |
| 4,428,850 | 1/1984 | Zoleski et al. | 252/42.7 |
| 4,734,211 | 3/1988 | Kennedy | 252/51.5 A |
| 4,764,296 | 8/1988 | Kennedy | 252/334 |
| 4,780,111 | 10/1988 | Dorer et al. | 252/56 R |
| 4,820,431 | 4/1989 | Kennedy | 252/56 R |
| 4,871,465 | 10/1989 | Hutchison | 252/47 |

FOREIGN PATENT DOCUMENTS

| | | |
|---|---|---|
| 1228847 | 11/1987 | Canada . |
| 2038356A | 7/1980 | European Pat. Off. . |
| 0092946A | 11/1983 | European Pat. Off. . |
| 2038355 | 7/1980 | United Kingdom . |

*Primary Examiner*—Jacqueline V. Howard
*Attorney, Agent, or Firm*—L. S. Squires; W. K. Turner

[57] ABSTRACT

Essentially chlorine-free lubricating compositions having a TBN of 10-30 designed for use in internal combustion engines having silver bearing parts which provide protection for said bearings via the incorporation therein of certain unsaturated aliphatic carboxylic acids. An additive concentrate for said lubricating compositions is also disclosed.

23 Claims, No Drawings

LUBRICATING OIL COMPOSITIONS FOR INTERNAL COMBUSTION ENGINES HAVING SILVER BEARING PARTS

BACKGROUND OF THE INVENTION

This invention relates to lubricating oil compositions for use in engines having silver bearings. In a further aspect, the invention relates to the protection of silver bearing parts in internal combustion engines.

As is well known, lubricating oils for heavy duty diesel engines require crankcase lubricating oils which are stabilized against oxidation and which limit the formation of engine deposits. In addition, these crankcase lubricating oils must also have a high alkalinity to neutralize acids formed during fuel combustion.

Many heavy duty railroad and tugboat diesel engines in use in the United States pose an additional lubrication problem, because they have silver-surfaced engine parts, such as silver or silver-plated bearings. While the foregoing properties of oxidation stability, deposit control and alkalinity can be achieved by the use of lubricating oil additives known in the art, many of the resulting oils cause unacceptable corrosion and wear to silver-surfaced diesel engine parts. Silver, or silver-surfaced bearing parts, pose a special problem since many of the bearing protection additives which are effective to protect bearings surfaced with other materials, e.g., brass, copper-lead, bronze, aluminum, are ineffective to protect silver bearing parts or, for example in the case of materials such as zinc dithiophosphate, commonly used in automotive spark-ignition engine lubricants, are known to be deleterious to silver bearings. A further problem is that in the case of railroad and inland marine engines, many have non-silver bearings, e.g., copper-lead bearings. However, pragmatically the user will want to use the same lubricating oil for all engines regardless of whether they have silver bearings or copper-lead bearings. Thus, as well as being effective for silver bearing parts, the lubricating composition should also be effective for non-silver bearings.

At present silver protection is largely provided by the use of lubricants containing chlorinated paraffins or other chlorinated additives. Examples of halogenated additives used to provide silver protection are, for example, described in U.S. Pat. Nos. 4,169,799; 4,171,269; and 4,131,551. However, a problem has arisen with respect to the use of halogenated additives in that they are perceived as presenting environmental problems. Thus, there is a need for lubricants which provide silver protection without the inclusion of halogenated additives.

In view of this need the art has already developed certain halogen-free or reduced halogen silver corrosion inhibitor-containing lubricants. For example, U.S. Pat. Nos. 4,764,296 and 4,734,211 disclose a marine and railway diesel engine lubricating oil composition containing certain polyhydroxy esters as silver wear inhibitors. These patents also disclose lubricating oil compositions containing a mixture of these polyhydroxy esters and chlorinated paraffins. U.S. Pat. No. 4,820,431 discloses a method for reducing silver wear in marine and railway diesel engines using similar lubricating oil compositions. U.S. Pat. No. 4,171,270 discloses lubricating oil compositions containing a sulfurized overbased calcium alkylphenolate and a sulfurized naphthenic base oil-containing composition having a sulfur content of from 1 percent to 6 percent by weight. These compositions are also thought to have silver protective properties. U.S. Pat. No. 4,871,465 discloses lubricating oils containing as a silver protectant (a) a sulfurized olefin, sulfurized fatty acid, sulfurized hydroxyaromatic, sulfur containing heterocyclic compounds, organic sulfide or dithiocarbamate and (b) the reaction product of a saturated aliphatic dicarboxylic acid with an optionally substituted aminoguanidine.

Other organic compounds have also been disclosed as providing silver protection. Thus U.S. Pat. No. 4,278,553 discloses a railway diesel engine lubricant containing a silver corrosion inhibitor comprising a benzotriazole compound present in concentrations from about 0.5 to 2.0 wt % and U.S. Pat. No. 4,285,823 discloses a diesel lubricant composition containing a silver corrosion-inhibiting amount of an N-substituted 5-amino-1H-tetrazole.

A continuing need exists for additives which provide silver protection without presenting potential environmental problems and preferably, which are readily available, relatively inexpensive and which are not deleterious to non-silver bearings such as copper-lead bearings. As before mentioned, a significant problem in meeting this need is the unpredictability of additive response with respect to silver bearing systems. One simply cannot predict whether a given additive will provide silver bearing protection based on its properties in lubricants for non-silver bearing engines or a general characterization of the additives' properties or function. Thus, for example, zinc dithiophosphates which are widely used to provide wear and oxidation protection, are recognized to be deleterious to the silver bearing parts of engines.

The art has suggested the addition of unsaturated carboxylic acids and a variety of esters thereof to various types of lubricants for a variety of reasons. Thus, as early as 1958, U.S. Pat. No. 2,851,422 suggested adding certain sulfurized compounds (e.g., sulfurized sperm oil) to transmission fluids to protect against corrosion and adding oleic acid to such compositions as an anti-squawk agent.

U.S. Pat. No. 2,830,956, directed to hydraulic power transmission fluids, teaches that it is well known that various of the common fatty acids, fatty oils and esters and their chlorinated derivatives have good oiliness characteristics and in accordance with patentee's invention, suggests adding the combination of an oil-soluble fatty acid having 14–22 carbon atoms with sulfurized or unsulfurized fatty oil to transmission fluids to impart improved oiliness. Patentee teaches that both the use of the two oiliness agents and the specific proportions taught by patentee are critical to the invention. Patentee also teaches that oleic acid, stearic acid, erucic acid are objectionally corrosive to certain types of metal but that this drawback can be overcome by the inclusion of conventional corrosion inhibitors and suggests sulfurized olefinic hydrocarbons as satisfactory corrosion inhibitors.

U.S. Pat. No. 3,267,033 directed to additives in lubricants for internal combustion engines, especially power transmission units, describes an additive combination of 1 to 3 parts by wt. of an oil-soluble fatty acid, preferably unsaturated and most preferably oleic acid, and 1 to 3 parts of a tertiary aliphatic primary amine salt of a partially esterified phosphoric acid as imparting desirable friction properties. Patentee also teaches that a particularly effective combination of additives for use in lubricants in gear assembles or differentials consists of the aforementioned additive combination and a hydrocarbon polysulfide and/or a neutralization product of an amine with certain acids.

Canadian Patent No. 1,228,847 is directed to lubricant compositions broadly comprising an aliphatic olefinic compound and a sulfurized olefinic hydrocarbon in a hydrorefined lubrication oil which are described as providing longer lasting properties, anti-wear capability and reduced staining of copper parts. Patentee teaches that the aliphatic olefinic compound is preferably a fatty acid or more preferably a fatty acid ester. The Canadian patent gives various examples of acids including tall oil and those obtained by the hydrolysis of fats such as palmitoleic acid, oleic acid, linoleic acid, linolenic acid, etc. Although primarily directed to multipurpose industrial oils for use in gear, hydraulic and other specialty applications, the patent also broadly teaches that its lubricating compositions can be used for a wide variety of purposes including crankcase lubricants for spark-ignition and compression-ignition combustion engines, including automotive and truck engines, two-cycle engines, aviation piston engines, marine and railroad diesel engines and the like and for stationary power engines, turbines, transmissions, transaxles, metal working lubricants and other lubricating oils and greases.

U.S. Pat. Nos. 3,112,269 and 3,112,271 cursorily teach that esters of carboxylic acids or phosphoric acid, e.g., partial esters of fatty acids and polyhydric alcohols or alkyl phosphites or phosphates, or free fatty acids and sulfuric derivatives thereof such as $C_{10}$–$C_{18}$ fatty acids (oleic or stearic acids) and sulfurized unsaturated fatty acids, e.g., sulfurized oleic acid, are anti-wear and extreme pressure agents for hydrocarbon combustions but when used in lubricating oils subject to high temperatures and pressures, break down and fail to impart their expected desired properties under extreme conditions.

U.S. Pat. No. 2,788,326 teaches that improved extreme pressure lubricants can be obtained by the use of heat polymerizable polyfunctional organic compounds containing a plurality of hydroxyl group, e.g., sorbitan monoleate.

U.S. Pat. Nos. 4,780,111 and 4,412,928 refer to the use of terephthalic acid to provide corrosion protection for lead bearings.

U.S. Pat. No. 3,041,284 suggests the use of fatty acids and fatty acid esters as clarifiers in oils containing certain mercapto modified acid or alcohol additives.

U.S. Pat. No. 4,428,850 suggests adding an estolide of a hydroxy fatty acid in railroad diesel engine lubricating oils as an antifoaming agent.

In the early '70's oleic acid was investigated as a friction modifier additive for lubricating oils for passenger car motors and heavy duty diesel oils for trucks to decrease fuel consumption. Although oleic acid was found to perform as a good friction modifier to decrease fuel consumption, it was believed to cause severe corrosion problems with respect to the lead-copper bearings generally used in such engines particularly with respect to the lead component of the bearings. Thereafter, efforts shifted from the acid per se to esters which were found to be less corrosive. U.S. Pat. No. 4,376,056 teaches the use of pentaerythritol oleate in lubricants for spark-ignition and compression-ignition engines to reduce friction and improve fuel economy. United Kingdom published Patent Application GB 2038356A attributes a similar utility to fatty acid esters of glycerol such as glycerol monoleate and glycerol tallowate, see also U.S. Pat. No. 4,304,678 extending this utility to hydroxyl containing acid esters, e.g., glycerol oleate and sorbitan oleate. European Patent Application No. 0 092 946A teaches that the use of lubricants containing both a glycerol ester and certain oil-soluble organic copper compounds improves performance and fuel economy and published U.K. Patent Application 2038355 teaches that improved fuel economy can be obtained using lubricants containing a glycerol ester and zinc O,O-di(2-ethylhexyl)phosphorodithioate.

SUMMARY OF THE INVENTION

It has now been surprisingly discovered that certain lubricating compositions containing unsaturated carboxylic acids, including oleic acid, are surprisingly effective inhibitors of silver corrosion when used in the crankcase lubricating oil of internal combustion engines containing silver-surfaced parts and further, may be effectively used in engines having copper-lead bearings without presenting corrosion problems.

The present invention provides an essentially chlorine-free lubricating composition having a TBN of about 10 to 30 comprising a major amount of an oil of lubricating viscosity and an amount of an unsaturated aliphatic carboxylic acid having 12 to 24 carbon atoms, or mixtures thereof, effective to inhibit or reduce silver wear or deterioration in internal combustion engines having silver bearing parts.

The term "essentially chlorine-free" refers to the absence of chlorinated compounds to provide silver protection and the absence of any amounts of chlorinated compounds which could be considered to have an adverse effect on the environment. TBN (Total Base Number) is a measure of the ability of the lubricant to neutralize acid as determined by the procedure described in ASTM D2896-85, and in general terms, is the neutralization capacity of one gram of the lubricating composition expressed as a number equivalent to the mg of potassium hydroxide providing the equivalent neutralization. Thus, a TBN of 10 means that one gram of the composition has a neutralization capacity equivalent to 10 mg of potassium hydroxide.

In a further embodiment, the invention provides a method of reducing silver bearing wear in internal combustion engines having silver bearing parts via the use of the present lubricating composition.

In another embodiment, the invention provides an additive package or concentrate having a TBN of 90 to 120 containing a small amount, generally under 20% by wt., of a diluent oil and an unsaturated aliphatic carboxylic acid having 12 to 24 carbon atoms, and wherein said carboxylic acid and the additive providing the TBN are in a relative weight ratio such that the additive package may be admixed with an oil of lubricating viscosity to provide a lubricant having a TBN of 10 to 30 and an amount of said carboxylic acid or mixture thereof effective to provide silver bearing protection.

DETAILED DESCRIPTION OF THE INVENTION

As above noted the compositions of the present invention contain an amount of certain unsaturated aliphatic carboxylic acid effective to provide silver protection for engines having silver bearings and at the same time may be safely used in engines having bearings made of other materials. In general, two theories are advanced as to why a material provides silver protection; i.e., the material may act as a lubricity agent or it may act as a silver pacifier (i.e., provides protection by entering into a chemical reaction with silver to form a bearing surface less susceptible to wear). Although one cannot predict how an additive will perform with silver bearings from its performance with respect to the bearings made from other materials, it is believed that in the present composition the carboxylic acid is performing as a lubricity agent with respect to the silver bearings. It is theorized that the present lubricating composition is safe with respect to bearings made of materials other than silver, notably copper-lead bearings, because of its relatively high TBN as compared with lubricating compositions normally used for automotive engines or diesel truck engines. Thus it is theorized that the higher alkalinity is performing some form of neutralization function. Though, this is also totally unexpected because on a stoichiometric basis the alkalinity of lubricants used for automotive and truck engines, e.g., TBN's of about 5, is more than sufficient to neutralize the small amount of carboxylic acid used as a silver protectant. In any event, regardless of the accuracy of the above theories, the present composition is effective to provide silver protection for silver bearings and yet may be safely used as a lubricant in engines having bearings made of other materials.

Considering now the lubricating composition of the invention in greater detail, the composition typically contains about from 0.8 to 3 wt %, preferably about from 0.85 to 2 wt % based on the total weight of the composition, of an aliphatic unsaturated carboxylic acid having 12 through 24 carbon atoms, preferably 14 through 22 carbon atoms or mixtures of such acids. More preferably the lubricating composition contains about from about 0.9 to 1.5 wt % of the aliphatic acids. The acids may be mono-unsaturated and/or di- or poly-unsaturated. Frequently, the unsaturated aliphatic acids are obtained most economically as mixtures and may contain a minor amount of saturated aliphatic carboxylic acid usually of around the same carbon atom chain length. The presence of small amounts of such saturated acids is not deleterious but neither does it aid in silver protection. Thus, where mixtures of saturated and unsaturated acids are used, only the unsaturated component should be considered in calculating the amount of acid for purposes of the present invention. Examples of suitable unsaturated aliphatic carboxylic acids include, for example, oleic acid, linoleic acid, palmitoleic acid, linolenic acid, lauricoleic acid, myristoleic acid and the like and mixtures thereof. Preferably the unsaturated carboxylic acid is a straight-chained (i.e., unbranched) unsaturated fatty acid.

The lubricating composition has a TBN of about 10 to 30, preferably 15 to 25. This is a measure of the alkalinity or neutralizing capacity and is typically provided by the addition of basic detergents or overbased materials. The function of the basic component is to neutralize acid oxidation products, such as sulfuric acid in the case of diesel fuels. In the case of the present invention, it is theorized as noted above that the basic component also reduced the corrosiveness of the unsaturated aliphatic acid without the need for special corrosion inhibitors. Various types of overbased materials can be used, such as, for example, sulfurized and/or carbonated phenates, salicylates, and sulfonates. Various overbased phenates are described in U.S. Pat. Nos. 2,680,096; 3,036,971; 3,336,224; 3,437,595; 3,801,507; and 4,251,379. Various overbased sulfonates are described in U.S. Pat. Nos. 2,616,904; 2,626,207; 2,767,209; 3,126,340; 3,524,814; and 3,609,076.

A base oil of lubricating viscosity will typically comprise a major portion of the present lubricating oil compositions which, in addition to the unsaturated aliphatic carboxylic acid, or mixtures of acids, will also typically contain other additives used to impart desirable properties to lubricating oil compositions used for internal combustion engines having silver bearing parts. Thus, the lubricating composition will typically contain various additives selected from detergent-dispersant additives, ashless dispersants, overbased additives, oxidation inhibitors and most preferably will contain a combination of such additives and optionally may contain viscosity inhibitors.

The base oil can be a mineral, synthetic or natural oil (vegetable or animal-derived oils), but from an economic standpoint, is preferably a mineral oil. Solvent refined and hydrorefined base oils may also be used. Frequently a mixture of different oils is used as the base oil. The individual oils typically have viscosities of about from 4 centistokes to 40 centistokes at 100° C., and preferably 8 to 14 centistokes at 100° C. The base oil or mixture of base oils are typically preselected so that the final lubricating oil, containing the various additives, has a viscosity at 100° C. of 4 to 22 centistokes, preferably 10 to 17 centistokes and more preferably 13 to 17 centistokes.

Detergent-dispersant additives are designed to keep sludge, carbon and products derived from the partial oxidation of the diesel fuel or base oil, suspended in the base oil. Suitable detergent-dispersants include phenate and sulfonate metallic detergents, for example, calcium phenate or sulfonate. Various ashless dispersants are described in U.S. Pat. Nos. 3,172,892; 3,219,666; 3,282,955; and 3,361,673. Succinimide and succinate ester ashless dispersants are typically prepared by the reaction of polyisobutenyl succinic anhydride with a polyalkylene polyamine or polyol, respectively.

The lubricating composition may also optionally contain viscosity index improvers ("VI improvers") to regulate viscosity, i.e., reduce viscosity changes produced by temperature changes, e.g., multi-grade oils. However, care must be taken in using viscosity index improvers because the VI improver may be deleterious to silver bearinqs. Thus, it may be desirable to increase the amount of the unsaturated aliphatic carboxylic acid or add additional corrosion inhibitors where viscosity index improvers are used. The viscosity index improver may be a non-dispersant viscosity improver or a dispersant viscosity improver, which acts as a dispersant as well as regulating viscosity. Examples of non-dispersant viscosity improvers include various oil-soluble polymers typically having molecular weights in the range of 20,000 to 1,000,000 and include alkyl methacrylate polymers, ethylene-propylene copolymers, mixed alkylmethyacrylate-ethylene-propylene polymers, isobutylene polymers, hydrogenated styrene-diene polymers, and the like. Dispersant viscosity improvers are also typically polymers, but which incorporate some degree of nitrogen functionality which imparts dispersancy to the molecular, in addition to the viscosity, regulating effect. Examples of dispersant viscosity improvers include styrene-based polyesters incorporating a succinimide or substituted succinimide [e.g., N-(3'-morpholin-4-ylpropyl) succinimide] unit; mixed alkyl methacrylate-vinyl pyrrolidone polymers; aminated ethylene-propylene polymers; and the like. Compatible mixtures of viscosity improvers can also be used.

With the possible exception of the inclusion of a viscosity index improver, typically, best overall results in terms of affording the properties desired in a modern lubricating oil composition for internal combustion engines having silver bearings are obtained wherein the lubricating composition contains a compatible combination of additives representing one or more and preferably each of the above classes of additives in effective amounts as well as the unsaturated aliphatic carboxylic acids and alkaline detergents or overbased materials used in accordance with the present invention.

The lubricating composition of the present invention may also contain small amounts, generally less than about 1 wt %, based on the total lubricating composition, of supplemental corrosion inhibitors without harming the properties of the composition and perhaps providing some additional benefit and as above noted, may be desirable when VI improvers are used. The corrosion inhibitor should not, of course, be a corrosion inhibitor such as, for example, zinc dithiophosphate which is itself corrosive to silver bearings. Where supplemental corrosion inhibitors are used they are generally used in amounts of about from 0.02 to 1 wt % of the lubricating composition. Additional amounts of supplemental corrosion inhibitor may not be harmful but generally are not beneficial. Thus, for example, the composition may contain, based on the total weight of lubricating composition, about 0.02 to 0.08 wt % of a sulfurized olefin corrosion inhibitor (for example, cosulfurized alkenyl ester/alpha olefins) and/or up to about 1% by wt., preferably about from 0.5 to 0.8 wt % of terephthalic acid or a salt or derivative thereof. A variety of sulfurized olefin corrosion inhibitors, as well as other corrosion inhibitors, are described in the published literature and are available commercially. The cosulfurized alkenyl ester/alpha olefin additives, for example, typically prepared by reacting a mixture of the desired olefins, typically $C_{12}$–$C_{20}$ linear olefins, and unsaturated esters, e.g., oleate, linoleate, with sulfur at moderate to elevated temperatures via known procedures. Various sulfurized olefin corrosion inhibitors or wear inhibitors are described in U.S. Pat. Nos. 4,053,427; 4,119,549 and 4,240,549. In the case of terephthalic acid corrosion inhibitors, either a solubilized form of the acid is used, or more conveniently, when the additive package includes a succinimide dispersant, the acid is simply solubilized by reaction with the succinimide dispersant to form an oil-soluble salt of terephthalic acid.

The present invention also provides an additive package or concentrate which may be added to an oil of lubricating viscosity either as the sole additive or in combination with other additives. (Generally, the additive package will not contain a viscosity index improver because even where desired the viscosity index improver is generally added to the base oil by the lubricant formulator.) Thus, a preferred additive concentrate contains about from 5 to 14 wt % more preferably 6 to 10 wt % of the unsaturated aliphatic carboxylic acid or mixtures thereof and sufficient basic material (typically overbased detergents) to provide the concentrate with a TBN of about from 60 to 180; and about 1 to 10 wt % preferably 2 to 6 wt % of a diluent oil. The concentrate will frequently also contain various other additives considered desirable for the intended use and generally will contain about from 30 to 60 wt % of an ashless dispersant and frequently will also contain neutral or slightly alkaline detergent in addition to the overbased detergent. The amount of overbased detergent needed to provide the requisite TBN will, of course, vary with the TBN of the overbased detergent but typically will be 20 to 80 wt % of the concentrate.

The various additive materials or classes of materials described above are known materials and can be prepared by known procedures or obvious modifications thereof and frequently are readily available from commercial sources.

A further understanding of the invention can be had from the following nonlimiting examples.

EXAMPLE 1

SILVER WEAR EVALUATION

The lubricating oil compositions identified in Table 1 hereinbelow were evaluated for silver wear protection by the standard silver bearing wear test EMD 2-567, also commonly known as the "2-Holer Test" used to assess the distress rating of a silver-plated wrist pin after 25 hours of operation.

The test formulations were prepared by blending the requisite amount of the indicated additive with a formulated 20W40 lubricating oil containing 4.0 wt % of a viscosity index improver and the requisite amount of a sulfurized overbased calcium phenate needed to give the TBN indicated in Table 1. In addition the formulated 20W40 oil contained small amounts of standard detergents and dispersants including a succinimide and 0.05 wt % of a commercial cosulfurized alkenyl ester/alpha olefin corrosion inhibitor and 0.78 wt % of terephthalic acid. Also in one test, a 40W grade oil was used. The 40W oil used a slightly different base oil but used the same additive package as the 20W40 oil with the exception of the deletion of the viscosity index improver. Two types or sources of oleic acid, i.e. commercial and food grade, were used as the silver protectant. The commercial oleic acid used for the test contained 91 wt % unsaturated $C_{14}$–$C_{18}$ fatty acids (i.e., 73 wt % oleic acid, 8 wt % linoleic acid, 6 wt % palmitoleic acid, 3 wt % myristoleic acid, 1 wt % linolenic acid) and the remainder (9 wt %) $C_{14}$–$C_{17}$ saturated fatty acids. The food grade oleic acid used in the test also contained 91 wt % unsaturated $C_{14}$–$C_{18}$ fatty acids (i.e., 75 wt % oleic acid, 6 wt % linoleic acid, 6 wt % palmitoleic acid, 3 wt % myristoleic acid) and 9 wt % saturated fatty acids (i.e., 5 wt % palmatic acid, 3 wt % myristic acid and 1 wt % margaric acid).

In the 2-holer test, the normally protected silver bushing of the wrist pin bushing assembly is replaced with an unprotected silver bushing. (Normally, the bushing is protected with a thin lead flashing to protect the silver surface from corrosion and high friction during break in.) Removal of the lead flashing greatly increases the test severity. The test engine used in this evaluation had a D-1 type assembly. (The D-1 configuration uses three chrome-plated and one ferrite-filled cast iron compression rings above the piston pin with one hooked scraper-type oil control ring and one ventilated cast iron ring below the pin. The nominal compression ratio was 20:1.)

The engine is kept in newly built condition by periodic replacement of the liners, pistons, rings, carriers, thrust washers, cam bearings, rods, rod bearings, main bearings, and reconditioned heads with new valves and rebuilt injectors.

For each silver wear test, the engine is thoroughly cleaned with a commercial petroleum-based solvent and the wrist pin replaced with a new piston pin and unprotected (i.e., unleaded) silver-plated pin bearings. Prior to conducting the silver wear test, the engine is given a full 9-hour and 20-minute EMD-type break-in. Following the break-in, the crankcase and air boxes are inspected for signs of bearing failure before the test phase is initiated. While under test, the engine is held at 835 rpm, 91±1.0 lbs./hr. fuel rate and 6.8 inches of Hg air box pressure by a distributed digital process control computer. The water and oil inlet temperatures are controlled at 180°±2° F. and 210°±2° F., respectively. The crankcase and all oil lines are flushed with test oil, and the crankcase is charged to its full capacity of 45 U.S. gallons. The fuel for these tests contained 0.1% sulfur and the cetane number is a nominal 47–50 No. 2 diesel. Each test is conducted using identical test conditions. The pin bearings were weighed before and after the test. The piston pin diameters and in-carrier clearances were taken before and after the test.

At the conclusion of the test, the pin bearings were removed and rated according to the EMD distress demerit procedure which measures and assigns demerits based on the amount of silver which has been displaced from the bearings into the oil grooves. An average of 30 or less demerits with neither of the two bearings having 40 or more demerits is considered a passing result.

As can be seen from the results shown in Table 1 where the lubricating oil contained 1% by wt. of either the food grade or commercial oleic acid (i.e., 0.91 wt % of $C_{14}$–$C_{18}$ unsaturated carboxylic acids), the lubricating oil passed the test. Where, however, the lubricating oil contained 0.75 or 0.85 wt % of food grade oleic acid (0.68 wt % and 0.77 wt %, respectively, based on unsaturated aliphatic carboxylic acid content) or 0.3 wt % of the commercial oleic acid, the lubricating oil failed the test; though the lubricating oil containing 0.85% food grade oleic acid was close to passing.

TABLE 1

SILVER WEAR TEST RESULTS

| Test No. | Silver Protectant Additive | Add. Wt. % | TBN | Lub. Oil Grade | Bearing Demerits Left | Bearing Demerits Right | Pass |
|---|---|---|---|---|---|---|---|
| 1 | Oleic Acid (Food Grade) | 0.75 | 17 | 20W/40 | 116.0 | 21.5 | No |
| 2 | Oleic Acid (Food Grade) | 0.85 | 17 | 20W/40 | 24.0 | 58.0 | No |
| 3 | Oleic Acid (Food Grade) | 1.00 | 17 | 20W/40 | 20.5 | 19.5 | Yes |
| 4 | Oleic Acid (Food Grade) | 1.00 | 17 | 20W/40 | 10.0 | 17.0 | Yes |
| 5 | Oleic Acid (Food Grade) | 1.00 | 17 | 20W/40 | 12.0 | 34.0 | Yes |
| 6 | Oleic Acid (Commercial) | 1.00 | 17 | 20W/40 | 9.0 | 12.0 | Yes |
| 7 | Oleic Acid (Commercial) | 1.00 | 17 | 20W/40 | 15.0 | 18.0 | Yes |
| 8 | Oleic Acid (Commercial) | 1.00 | 17 | 20W/40 | 9.0 | 15.0 | Yes |
| 9 | Oleic Acid (Commercial) | 1.00 | 17 | 40 | 13.0 | 12.5 | Yes |
| 10 | Oleic Acid (Commercial) | 0.3 | 10 | 20W/40 | 440.0 | 44.0 | No |
| 11 | Oleic Acid (Commercial) | 1.00 | 10 | 20W/40 | 13.8 | 10.0 | Yes |

EXAMPLE 2

L-38 ENGINE TESTS

In this Example the formulations identified in Table 2 were evaluated for performance in engines having copper-lead bearings by the Labeco L-38 Test Method, ASTM D 5119-90. The test formulations are prepared by blending the requisite amount of the test additive with formulated 20W40 oil containing the requisite amount of sulfurized overbased calcium phenate to give the TBN indicated in Table 2, but, otherwise identical to the formulated 20W40 oil used in Example 1.

The Labeco L-38 Test Method, ASTM D 5119-90, is designed to evaluate crankcase lubricating oils for resistance to oxidation stability, corrosion, sludge and varnish when subjected to high temperature operation. When Multi Grades are tested, it also evaluates shear stability of the test oil.

The procedure involves the operation of the single cylinder CLR oil evaluation engine under constant speed, air-fuel ratio and fuel flow conditions for extended duration (commonly 80 hours), subsequent to a break-in period of 4½ hours. Prior to each run, the engine is thoroughly cleaned, pertinent measurements of engine parts are taken, and new piston, piston rings and copper-lead connecting rod bearing inserts are installed.

Bearing weight loss data is obtained at 40 hours, and at the completion of the extended test duration.

The key engine operating conditions for this evaluation are as follows:

| | |
|---|---|
| Duration | 40, 80 Hours (may be extended) |
| Speed | 3150 ± 25 rpm |
| Load | Adjusted to provide proper fuel flow at specified air-fuel ratio |
| Fuel Flow | 4.75 ± 0.25 lbs/hr |
| Air-Fuel Ratio | 14.0 ± 0.5 |
| Jacket-Out Temperature | 200 ± 2° F. |
| Difference between Jacket-In and Jacket-Out Temperatures | 10 ± 2° F. |
| Gallery Oil Temperature | SAE 20, 30, 50, and Multi Grades: 290 ± 2° F. SAE 10: 275 ± 2° F. |

At the conclusion of the run, the engine is disassembled and the performance of the oil is judged by the following: 1) a visual examination of the engine for deposits; 2) by the weight loss of the copper-lead bearing; 3) and by comparing the periodic oil sample analysis with the new oil analysis.

The results of this test are given in Table 2. As can be seen from the test results, the TBN 17 lubricating oil passed this test even after 200 hours whereas the TBN 5 lubricating oil which was otherwise identical to the TBN 17 lubricating oil failed dramatically after only 40 hours, even though it also contained 0.05 wt % of the cosulfurized alkenyl ester/alpha olefin corrosion inhibitor and 0.78 wt % of terephthalic acid.

TABLE 2

L-38 ENGINE TEST RESULTS

| Test No. | Silver Protectant Additive | Add. Wt. % | TBN | Lub. Oil Grade | Test Hours | Bearing Wt. Loss, mg Top | Bottom | Total | Pass |
|---|---|---|---|---|---|---|---|---|---|
| 1 | Oleic Acid (Food Grade) | 1.0 | 17 | 20W/40 | 40 | 11.9 | 9.7 | 21.6 | Yes |
| 2 | Oleic Acid (Food Grade) | 1.0 | 17 | 20W/40 | 80 | 9.6 | 5.3 | 14.9 | Yes |
| 3 | Oleic Acid (Food Grade) | 1.0 | 17 | 20W/40 | 200 | 38.3 | 26.2 | 64.5 | Yes |
| 4 | Oleic Acid (Food Grade) | 1.0 | 5 | 20W/40 | 40 | 2,105.5 | 1,932.9 | 4,038.4 | No |

Obviously, many modifications of the invention described hereinabove and below can be made without departing from the essence and scope thereof.

What is claimed is:

1. An essentially chlorine-free lubricating composition having a TBN of about from 10 to 30, suitable for use in internal combustion engines having silver bearings or copper-lead bearings, which comprises a major amount of an oil or mixture of oils of lubricating viscosity and an amount in the range of about 0.8 to 3 wt %, effective to inhibit or reduce wear or deterioration of said silver bearings without injuring copper-lead bearings of a silver protectant selected from the group consisting of unsaturated aliphatic carboxylic acids having from 12 through 24 carbon atoms and mixtures thereof, with the proviso that said composition contains no more than 0.08 wt % of a sulfurized olefin corrosion inhibitor.

2. The lubricating composition of claim 1 wherein said silver protectant is selected from the group consisting of unsaturated aliphatic carboxylic acids containing 14 through 22 carbon atoms.

3. The lubricating composition of claim 1 wherein a major portion of said silver protectant is oleic acid.

4. The lubricating composition of claim 1 wherein said silver protectant is the sole silver protectant additive or corrosion inhibitor additive in said composition.

5. The lubricating composition of claim 1 wherein said composition has a TBN of about from 15 through 25.

6. The lubricating composition of claim 1 wherein said lubricating composition contains about from 0.9 wt % to 1.5 wt % of said silver protectant.

7. The lubricating composition of claim 1 wherein said lubricating composition contains about from 0.85 wt % to 2 wt % of said silver protectant.

8. The lubricating composition of claim 1 wherein said composition contains about from 0.02 to 1 wt % of a supplemental corrosion inhibitor which is not deleterious to silver or mixtures thereof.

9. The lubricating composition of claim 1 wherein said composition contains about from 0.02 to 0.08 wt % of a sulfurized olefinic corrosion inhibitor.

10. The lubricating composition of claim 9 wherein said corrosion inhibitor is a cosulfurized alkenyl ester/alpha olefin.

11. The lubricating composition of claim 1 wherein said composition contains about from 0.5 to 1 wt % of an oil-soluble terepthalic acid corrosion inhibitor.

12. The lubricating composition of claim 1 wherein said silver protectant is selected from the group consisting of unsaturated aliphatic carboxylic acids having 14 through 18 carbon atoms and mixtures thereof.

13. The lubricating composition of claim 1 wherein said composition does not contain a sulfurized olefin corrosion inhibitor.

14. A method of reducing silver bearing wear or abrasion in internal combustion engines having silver bearings which comprises lubricating said bearings with the lubricating composition of claim 1.

15. A method of reducing silver bearing wear or abrasion in internal combustion engines having silver bearings which comprises lubricating said bearings with the lubricating composition of claim 3.

16. A method of reducing silver bearing wear or abrasion in internal combustion engines having silver bearings which comprises lubricating said bearings with the lubricating composition of claim 5.

17. A method of reducing silver bearing wear or abrasion in internal combustion engines having silver bearings which comprises lubricating said bearings with the lubricating composition of claim 8.

18. An essentially chlorine-free lubricating composition, for use in internal combustion engines having silver bearings, consisting essentially of a major amount of a mineral oil or synthetic oil of lubricating viscosity; about from 1 to 5 wt % of an alkaline detergent; about from 1 to 7 wt % of a succinimide ashless dispersant; about from 0.5 to 0.8 wt % of terephthalic acid; about from 0.02 to 0.08 wt % of a sulfurized olefin corrosion inhibitor; sufficient overbased detergent to provide the lubricating composition with a TBN of about from 10 to 30; and an amount in the range of about from 0.8 to 3 wt % effective to inhibit or reduce wear or abrasion of said silver bearings of a silver protectant selected from the group consisting of unsaturated aliphatic carboxylic acids having from 12 through 24 carbon atoms and mixtures of such acids.

19. The lubricating composition of claim 18 wherein the lubricating composition contains about from 0.9 to 1.5 wt % of said silver protectant.

20. An essentially chlorine-free lubricating additive concentrate, for use in lubricating oils for diesel engines having silver bearings, which comprises about from 1 to 10 wt % of a diluent oil, about from 20 to 80 wt % of an overbased detergent sufficient to provide the concentrate with a TBN of about from 90 to 120, and about 5 to 14 wt % of a silver protectant selected from the group consisting of unsaturated aliphatic carboxylic acids having from 12 through 24 carbon atoms and mixtures thereof and no more than an amount of a sulfurized olefin sufficient to provide a concentration of said sulfurized olefin of 0.08 wt % in said lubricating oil when said concentrate is formulated in said lubricating oil at a rate sufficient to provide a concentration of about from 0.85 to 2 wt % of said silver protectant in said lubricating oil.

21. The concentrate of claim 20 wherein said concentrate contains 6 to 10 wt % of said unsaturated alphatic carboxylic acid or mixtures thereof.

22. The concentrate of claim 21 wherein said unsaturated alphatic carboxylic acids have from 14 through 22 carbon atoms.

23. The additive concentrate of claim 20 wherein said concentrate does not contain a sulfurized olefin corrosion inhibitor.

* * * * *